United States Patent [19]

Romberger et al.

[11] Patent Number: 4,502,978

[45] Date of Patent: Mar. 5, 1985

[54] METHOD OF IMPROVING INHIBITOR EFFICIENCY IN HARD WATERS

[75] Inventors: John A. Romberger, Oak Park; Daniel A. Meier, Naperville, both of Ill.

[73] Assignee: Nalco Chemical Company, Oak Brook, Ill.

[21] Appl. No.: 439,705

[22] Filed: Nov. 8, 1982

[51] Int. Cl.[3] ..... C23F 11/18

[52] U.S. Cl. ..... 252/389 A; 252/181; 252/392; 210/697; 210/701; 422/16; 422/18

[58] Field of Search ..... 252/181, 388, 389.2, 252/392; 106/14.12, 14.13; 203/7; 210/697, 701; 422/15, 16, 18

[56] References Cited

U.S. PATENT DOCUMENTS

| | | | |
|---|---|---|---|
| 3,463,730 | 8/1969 | Booth et al. | 210/701 |
| 3,793,194 | 2/1974 | Zecher | 210/697 |
| 3,891,568 | 6/1975 | Nishio et al. | 422/15 X |
| 3,941,562 | 3/1976 | Hollingshad | 252/181 X |
| 3,965,027 | 6/1976 | Boffardi et al. | 422/16 X |
| 3,992,318 | 11/1976 | Gaupp et al. | 252/181 X |
| 4,126,549 | 11/1978 | Jones et al. | 422/16 X |
| 4,143,222 | 3/1979 | Goretta et al. | 526/64 |
| 4,196,272 | 4/1980 | Goretta et al. | 526/64 |
| 4,361,492 | 11/1982 | Dubin | 210/710 X |
| 4,387,027 | 6/1983 | May et al. | 252/181 X |

FOREIGN PATENT DOCUMENTS

| | | | |
|---|---|---|---|
| 247 | 1/1970 | Japan | 422/7 |

*Primary Examiner*—Ben R. Padgett
*Assistant Examiner*—Matthew A. Thexton
*Attorney, Agent, or Firm*—John G. Premo; Robert A. Miller; Donald G. Epple

[57] ABSTRACT

A method of enhancing corrosion inhibition of inorganic corrosion inhibitors, particularly stabilized phosphate corrosion inhibitors, when used in high hardness waters containing at least 800 ppm total hardness which comprises adding to the high hardness waters a combined product which includes both the inorganic corrosion inhibitor system and an effective amount of a water-soluble acrylic acid:acrylamide copolymer having an acrylic acid:acrylamide weight ratio between 1:4 and 1:2 and having a molecular weight between 1,000–25,000.

4 Claims, 1 Drawing Figure

THE EFFECT OF ACRYLIC ACID/ACRYLAMIDE COPOLYMER ON THE CORROSION OF MILD STEEL

—— $PO_4 + K_4P_2O_7$

- - - $PO_4 + K_4P_2O_7 +$ COPOLYMER

THE EFFECT OF ACRYLIC ACID/ACRYLAMIDE COPOLYMER ON THE CORROSION OF MILD STEEL

—— $PO_4 + K_4P_2O_7$

- - - $PO_4 + K_4P_2O_7 +$ COPOLYMER

METHOD OF IMPROVING INHIBITOR EFFICIENCY IN HARD WATERS

INTRODUCTION

Figure 1:
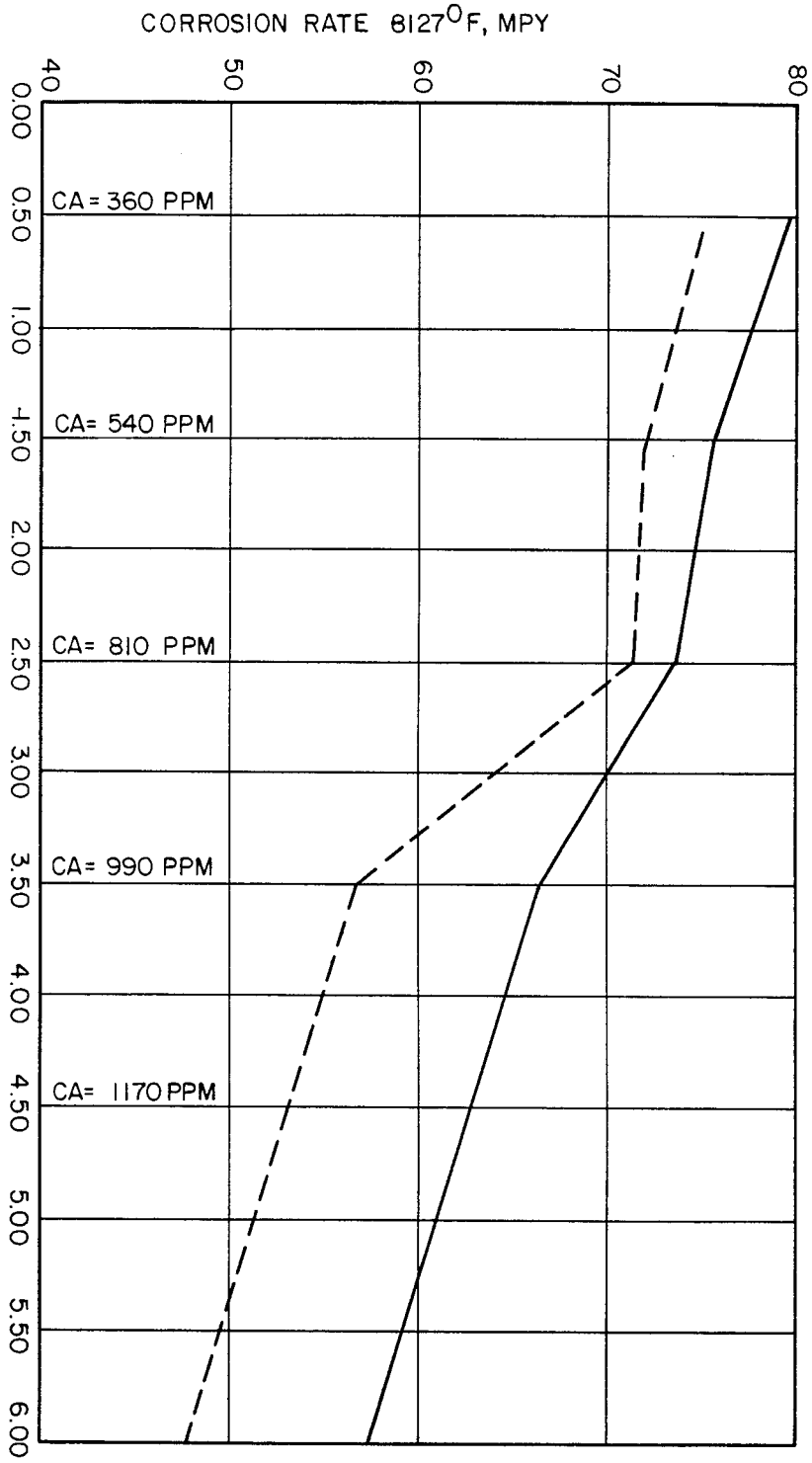

Corrosion and scale inhibitors used in industrial waters perform best when the hardness content of waters is below a certain level. This level is normally referred to as the hardness limit in reference to each of the corrosion and scale inhibitor programs.

Specifically, hardness, mainly in the form of both soluble calcium and magnesium salts, is most commonly calculated as calcium hardness and the corrosion and scale inhibitors perform best when this calcium hardness is below a certain calcium limit for each of the inhibitor programs.

Once the calcium concentration exceeds this limit for each of the corrosion inhibitor programs, the inhibitor's effectiveness for inhibiting corrosion is drastically reduced, presumably because of interaction between hardness ions and inhibitor or metal substrates. The only recourse in the past has been to increase the dosage of treatment chemical or to remove the hardness levels from these waters. Both of these solutions to this problem were often quite expensive and, occasionally, did not even function effectively.

It would therefore be a major advance in the art if one could develop a simple additive program which, when added to high hardness waters, would enhance the effectiveness of corrosion and scale inhibition in these high hardness waters when the typical inorganic corrosion inhibitor systems were being used to control metallic corrosion and to prevent scale formation.

THE INVENTION

We have found a method of enhancing the corrosion inhibiting effect of inorganic corrosion inhibitors which comprises adding to such inorganic corrosion inhibitors an effective amount of water-soluble acrylic acid/acrylamide copolymer having a molecular weight between 1,000–25,000. We have discovered a method of enhancing the corrosion-inhibiting effect of inorganic corrosion inhibitors in corrosive water systems which comprises adding to such inorganic corrosion inhibitors an effective amount of a water-soluble acrylic acid/acrylamide copolymer having a weight ratio of acrylic acid to acrylamide of from 1:4 to 1:2 and having a molecular weight between 1,000–25,000.

Preferably, our method of enhancing the corrosion inhibiting effect of inorganic corrosion inhibitors in high hardness waters comprises adding to the high hardness waters in which the corrosion inhibitor is present an effective amount of a water-soluble acrylic acid/acrylamide copolymer having an acrylic acid/acrylamide weight ratio between 1:4 and 1:2 and having a molecular weight between 1,000 and 25,000.

Out most perferred method of enhancing corrosion inhibition effects within inorganic corrosion inhibitor systems used in high hardness waters comprises formulating the inorganic corrosion inhibitors with an effective amount of a water-soluble acrylic acid/acrylamide copolymers having an acrylic acid/acrylamide weight ratio between 1:4 and 1:2 and having a molecular weight between 1,000 and 25,000. After the inorganic corrosion inhibitor has been formulated with the acrylic acid/acrylamide copolymers described above, this combined formulated product may be added to high hardness waters exposed to metallic substrates which require protection from corrosion and scale formation such that the addition of an effective amount of the inorganic corrosion inhibitor also adds the acrylic acid:acrylamide copolymer to the water system at a concentration of at least 1 ppm.

THE INORGANIC CORROSION INHIBITORS

Corrosion in recirculating heat transfer water systems is normally controlled by employing one or more of four major inhibitors along with a variety of minor supplements. The four basic inorganic inhibitors are chromate, zinc, orthophosphate, and polyphosphate systems. These systems may be supplemented by the addition of minor amounts of molybdate, nitrite, nitrate, various organic nitrogen compounds, silicates, and occasionally natural organic compounds. Each of these inorganic systems has its advantages and disadvantages. For example, the chromate system is an extremely effective corrosion inhibitor but creates environmental impact problems from the potential toxicity of the chromate hexavalent oxidation state. The chromate system is also preferably used at low pH and is essentially ineffective at high pH's due to its precipitation from waters at those high pH's.

Because of concern for the environment, inorganic systems which best perform at high pH's have become more important. As a result, the zinc, phosphate, and polyphosphate systems have become increasingly important in this business and technological area. The zinc system has similar environmental impact as does chromium and, therefore, more emphasis has been placed recently on the phosphate and polyphosphate systems in regards to corrosion inhibiting phenomena. Some corrosion inhibition programs include combinations of, for example, zinc and phosphate inhibitors.

However, these phosphate and polyphosphate systems are particularly sensitive to high hardness waters since it is a known fact that calcium and magnesium phosphates have a tendency to precipitate, form scale, and thereby cause the phosphate and polyphosphate systems to lose effectiveness in regards to a corrosion inhibiting program.

HIGH HARDNESS WATERS

When we use the term, "high hardness waters," we mean to indicate that we are treating industrial waters used in industrial cooling systems or any industrial water system which is used to transfer heat from a process stream to better control the process. These recirculating heat transfer water systems normally use whatever water source is available which has the volume and quantity of waters which may be used for these industrial purposes. For the most part, these waters contain less than 200 ppm total hardness, both magnesium as well as calcium hardness. When hardness of this type is encountered, the inorganic corrosion inhibiting systems referred above normally obtain excellent results and more than adequately protect the metal substrates which are exposed to these industrial waters. However, when calcium hardness regularly exceeds 400 ppm, difficulties can occur when using the inorganic systems discussed above. When calcium and magnesium hardness combined exceed 600 ppm, then these systems become ineffective and are normally not used without the addition of other chemicals.

Even with the addition of other chemicals such as low molecular weight acrylate dispersants, when the total hardness of these industrial waters exceeds 800 ppm, the inorganic corrosion inhibition systems become essentially non-functional and unacceptable corrosion rates in excess of 20 mpy on carbon steel are common.

It is at a level of 800 ppm and above that we have surprisingly found that the copolymers of this invention serve to enhance the corrosion inhibiting effect of the inorganic corrosion inhibiting systems described above, particularly the systems based on orthophosphate, polyphosphate, and the "stabilized" phosphate systems.

We, therefore, mean by the term, "high hardness waters," those industrial waters which contain at least 800 ppm total hardness, both calcium and magnesium, regardless of the form of calcium or magnesium salts, soluble or insoluble and dispersable.

THE ENHANCEMENT COPOLYMER

The copolymers which have been found to enhance corrosion inhibition effects of these inorganic corrosion inhibitors described above are primarily copolymers of water-soluble acrylic acid and acrylamide monomers. The acrylic acid/acrylamide copolymers may also be formed by base hydrolysis of low molecular weight homopolymers of acrylamide if techniques to control the preferred ratio of monomer repeating units can be found. The most effective ratio of monomers used to form these copolymers is the weight ratio of acrylic acid to acrylamide ranging between 1:4 to 1:2. The most effective weight ratio of acrylic acid to acrylamide is a 1:3 weight ratio of these monomers synthesized in such a way as to have a molecular weight between 1,000–25,000. The most preferred molecular weight of this 1:4 to 1:2 weight ratio of acrylic acid/acrylamide is between 5,000–15,000.

The copolymers described above are added to the circulating waters at a concentration of at least 1 ppm. Preferably, the treatment level for these copolymers is between 1–150 ppm. Most preferably, the treatment level is between 5 to 100 ppm.

The polymers may be added to the inhibitor treated cooling tower water as such or may be formulated with the inorganic corrosion inhibitor itself before addition to the recirculating water system. In addition, other additives such as the low molecular weight acrylate dispersants may also be added. This preferred copolymer is surprisingly found to be effective for its purpose in the presence or absence of these additional polymeric dispersants. Other organic corrosion inhibitors may also be added without effecting the advantage of these polymers.

The water-soluble acrylic acid/acrylamide copolymers which have an acrylic acid/acrylamide monomer weight ratio between 1:4 to 1:2 and have a molecular weight between 1,000–25,000 are preferably manufactured by copolymerization of these prescribed weight ratios of the two monomers in aqueous solution in the continuous polymerization method taught in U.S. Pat. No. 4,143,222 and U.S. Pat. No. 4,196,272, which are both incorporated herein by reference.

To better illustrate the invention disclosed herein, the following examples are provided.

EXAMPLES

Example 1

Two tests were run in which a stabilized phosphate inhibitor was used to inhibit the corrosion of mild steel tubes in a heat transfer unit. Each test was run for 7 days. Calcium concentration of the circulating waters was gradually increased from 100 ppm to 1200 ppm during the first 4 days of the test and remained at 1200 ppm calcium hardness for the last 3 days. The calcium limits of this untreated stabilized phosphate inhibitor treatment is found to be around 800 ppm. The stabilized phosphate inhibitor contained both polyphosphate as well as an acrylic acid-methacrylic acid low molecular weight copolymer used as a dispersant. This commercial formulation also contained sodium tolyltriazole as an additional organic corrosion inhibitor.

In the first test, the stabilized phosphate inhibitor formulation was tested alone. Other than the dispersants and triazole inhibitor added in this formulation, no additional active materials were present other than the stabilized phosphate inhibitor itself. The corrosion rate at the end of this test was measured at 7.4 mils per year (mpy).

In a second test, this same stabilized phosphate inhibitor formulation was run at identical concentrations under the same conditions as described above. However, to this circulating water was added about 5 ppm of a copolymer of acrylic acid/acrylamide haing a monomer weight ratio of 1:3 acrylic acid:acrylamide, and having a molecular weight of about 10,000. At the end of the 7 day test period, the mild steel tubing showed very little corrosion having a measured corrosion rate of 1.9 mpy, a very dramatic 389 percent improvement.

Hence, it is discovered that very small amounts of the acrylic acid:acrylamide copolymer described above has obtained a tremendous (389%) improvement in corrosion inhibition using the stabilized phosphate inhibitor system in high hardness waters.

Example 2

A power generating utility in the Southwestern United States was having difficulty controlling corrosion and scale in their cooling systems. The water circulating within this cooling system ran levels of calcium hardness of at least 1200 ppm, often exceeding this level. This high hardness circulating water created great problems in regards to corrosion and scale control on the metal surfaces exposed to the circulating water of these industrial systems. Stabilized phosphate programs had been known to normally fail to protect metal systems in this high hardness water when the calcium hardness level was increased above 800 ppm.

In spite of this knowledge, this industrial water system was treated with a stabilized phosphate program which failed to protect the cooling system components from corrosion and scale formation. However, in an attempt to solve this problem, a small amount of a product containing the acrylic acid/acrylamide copolymers of this invention was added to the system for a short period of time. Corrosion rates were measured for both mild steel and admiralty on several occasions under this combined treatment program. Initial corrosion rates for mild steel were measured at 6.77 and 12.33 mpy. Corrosion rates on admiralty were measured at 1.75 and 1.96 on two separate occasions. The initial reading was made shortly after the product containing the acrylic acid/acrylamide copolymer of this invention was added to the high hardness waters circulating within this cooling system. The second corrosion rate reading was made after the product containing the acrylic acid/acrylamide copolymer of this invention was no longer being added to the high hardness waters circulating within this system. This result hinted at the improved corrosion protection later verified.

It was decided to continuously feed a formulation containing the acrylic acid/acrylamide copolymer described above throughout a third test program. During this test program, calcium hardness in these circulating waters was always above 800 ppm, was most always about 1200 ppm, and did have occasional excursions in excess of 1200 ppm calcium hardness. In less than a week's time on this combined treatment program, the corrosion rate for mild steel dropped to 4.2 mpy and the corrosion rate for admiralty dropped to 0.7 mpy.

Example 3

The commercial utility station in the Southwestern United States has continued on this stabilized phosphate program with the addition of the copolymers of Example 2 and its corrosion rate for mild steel has dropped from an initial rate of about 20 mpy to an average corrosion rate using this system of about 2.5 mpy. The acrylic acid/acrylamide copolymers used at this industrial site have been added to the aqueous system at a concentration level ranging between 1 ppm and 150 ppm of this low molecular weight water-soluble copolymer. The most preferred concentration range has been found to be between 5 ppm and 100 ppm of this product, however, this preferred concentration range seems to be sensitive to the total concentration of calcium hardness measured in this circulating water. As stated earlier, the stabilized phosphate corrosion inhibitor used in all of the examples above contains tetrapotassium pyrophosphate, tolyltriazole, and a small amount of a acrylic acid/methacrylic acid dispersant. This stabilized phosphate program was not effective in the high hardness waters outlined above but became extremely effective for inhibiting corrosion rates on both mild steel and on admiralty metals when an effective amount of the water-soluble acrylic acid/acrylamide copolymer having a 1:4 to 1:2 weight ratio of acrylic acid to acrylamide and having a molecular weight between 1,000–25,000 was added to the circulating waters at a concentration ranging between 1 ppm and 150 ppm.

Example 4

Two mild steel coupons were placed into separate beakers containing water which had 360 ppm calcium and 200 ppm magnesium dissolved therein at a pH of 6.5. In the first beaker, 17 ppm potassium pyrophosphate and 1 ppm orthophosphate were added. Into the second beaker, the same quantities of pyrophosphate and orthophosphate were added and, in addition, 15 ppm of our preferred acrylic acid/acrylamide copolymer was also added.

Both beakers were maintained at 127° F. while the calcium and magnesium levels in each beaker were increased to maximum levels, 1170 ppm calcium and 644 ppm magnesium. Polarization measurements were made periodically to determine instantaneous corrosion rates of these coupons.

The results of these studies are indicated in FIG. 1. Under the described conditions, the corrosion rate is initially very high and it decreases with time as the phosphates begin to inhibit corrosion. The rate of decrease in corrosion is reduced by increasing levels of calcium and magnesium concentrations. FIG. 1 readily shows the corrosion behavior of each coupon. As can be observed from FIG. 1, the presence of the preferred copolymer of acrylic acid and acrylamide produces lower initial corrosion rates which decreased at a faster rate than if the sample wasn't treated with copolymer in the untreated media. The corrosion rate decreased from an initial 81.2 mpy to 57.6 mpy in 6 hours time. In the presence of the preferred copolymer, the corrosion rate was initially 76.8 mpy and decreased to b 47.4 mpy in the same time period. This demonstrates the drastic improvement observed when these preferred copolymers are added to aqueous systems in high hardness waters.

Having described our invention, we claim:

1. A method of enhancing the corrosion inhibiting effect of phosphate and polyphosphate inorganic corrosion inhibitors when used in high hardness waters containing at least 800 parts per million total hardness in contact with mild steel and admiralty metals which comprises adding to the high hardness waters containing said inorganic corrosion inhibitors from 1–150 ppm of a water-soluble acrylic acid:acrylamide copolymer having a monomer weight ratio of 1:4 to 1:2 of acrylic acid:acrylamide and having a molecular weight between 1,000–25,000.

2. The method of claim 1 in which the inorganic corrosion inhibitor is a stabilized phosphate inhibitor.

3. The method of claim 1 wherein the acrylic acid:acrylamide copolymer is formulated with the phosphate and polyphosphate inorganic corrosion inhibitors such that the addition of an effective amount of the inorganic corrosion inhibitor will also add at least 1 ppm of the acrylic acid:acrylamide copolymer.

4. The method of claim 1 wherein the phosphate and polyphosphate inorganic corrosion inhibitors are also formulated with low molecular weight acrylic acid:methacrylic acid dispersants and with tolyl triazole.

* * * * *